US007794116B2

(12) United States Patent
Shuai et al.

(10) Patent No.: US 7,794,116 B2
(45) **Date of Patent: *Sep. 14, 2010**

(54) LED LAMP WITH A HEAT DISSIPATION DEVICE

(75) Inventors: Chun-Jiang Shuai, Shenzhen (CN); Guang Yu, Shenzhen (CN)

(73) Assignees: Fu Zhun Precision Industry (Shen Zhen) Co., Ltd., Shenzhen, Guangdong Province (CN); Foxconn Technology Co., Ltd., Tu-Cheng, Taipei Hsien (TW)

( * ) Notice: Subject to any disclaimer, the term of this patent is extended or adjusted under 35 U.S.C. 154(b) by 203 days.

This patent is subject to a terminal disclaimer.

(21) Appl. No.: 12/169,643

(22) Filed: Jul. 9, 2008

(65) Prior Publication Data

US 2010/0008094 A1 Jan. 14, 2010

(51) Int. Cl.
*F21V 29/00* (2006.01)

(52) U.S. Cl. ..... 362/294; 362/249.02; 362/311.02

(58) Field of Classification Search ..... 362/294, 362/249.02, 612, 555, 545, 311.02, 500, 362/547, 218, 264, 345, 373; 165/80.3
See application file for complete search history.

(56) References Cited

U.S. PATENT DOCUMENTS 3,566,959 A * 3/1971 Koltuniak et al. ..... 165/80.3
5,969,950 A * 10/1999 Tantoush ..... 361/704
6,964,501 B2 * 11/2005 Ryan ..... 362/294
7,513,639 B2 * 4/2009 Wang ..... 362/218

* cited by examiner

*Primary Examiner*—Gunyoung T Lee
(74) *Attorney, Agent, or Firm*—Frank R. Niranjan

(57) ABSTRACT

An LED lamp includes a first heat sink, a second heat sink attached to the first heat sink and a LED module thermally attached on the second heat sink. The first heat sink includes a substrate and a plurality of first fins arranged on the substrate. A plurality of channels are defined between the first fins of the first heat sink. A plurality of traverse grooves are extended through all of the first fins and the channels between the first fins. The grooves are spaced from each other a distance along a lengthwise direction of the first heat sink. The channels are divided into a plurality of parts separated from each other by the grooves. The channels and grooves of the first heat sink increase contact area of the first heat sink and air surrounding the first heat sink.

11 Claims, 5 Drawing Sheets

LED LAMP WITH A HEAT DISSIPATION DEVICE

BACKGROUND OF THE INVENTION

1. Field of the Invention

The present invention relates to a light emitting diode (LED) lamp, and more particularly to an LED lamp incorporating a heat dissipation device for improving heat dissipation of the LED lamp.

2. Description of Related Art

With the continuing development of scientific technology, light emitting diodes have been widely used in the illumination field due to their high brightness, long life-span, and wide color gamut.

LED modules for use in a display or an illumination device require many LEDs, and most of the LEDs are driven at the same time, which results in a quick rise in temperature of the LED module.

As LED technology continues to advance, more and more heat dissipation devices are applied to the LED modules for dissipating heat from the LED modules. A related heat dissipation device attached to an LED module usually comprises a heat sink having a base and a plurality of fins mounted on the base. The fins are located parallel to each other and perpendicular to the base. A plurality of channels are defined between the fins of the heat sink and arranged parallel to each other. Through a natural air convection through the channels, heat of the fins from the base by absorbing the heat generated by the LED module can be dissipated to atmosphere. Accordingly, the LED module can be cooled to some degree.

However, by the provision of the fins and the unidirectional channels defined between the fins, the natural air convection cannot have a sufficient heat exchange with the fins, whereby the heat generated by the LED module cannot be timely dissipated to surrounding atmosphere, and performance of the LED lamp incorporating the LED module is accordingly undesirably affected.

What is needed, therefore, is an LED lamp with a heat dissipation device which can overcome the above-mentioned disadvantages.

SUMMARY OF THE INVENTION

The present invention relates to an LED lamp. According to a preferred embodiment of the present invention, the LED lamp includes a first heat sink, a second heat sink attached to the first heat sink and a LED module thermally attached on the second heat sink. The first heat sink includes a substrate and a plurality of first fins arranged on the substrate. A plurality of channels are defined between the first fins of the first heat sink. A plurality of traverse grooves are extended through all of the first fins and all of the channels between the first fins, wherein the grooves are spaced from each other a distance along a lengthwise direction of the first heat sink. The channels are divided into a plurality of parts separated from each other by the grooves. The channels and grooves of the first heat sink increase contact area of the first heat sink and air surrounding the first heat sink. Furthermore, the channels and grooves enable natural air convection through the first fins of the first heat sink via different directions, whereby heat from the base of the second heat sink absorbing heat from the LED module can be more effectively dissipated to the surrounding air.

Other advantages and novel features will become more apparent from the following detailed description of preferred embodiments when taken in conjunction with the accompanying drawings.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

DETAILED DESCRIPTION OF THE INVENTION

Figure 1:
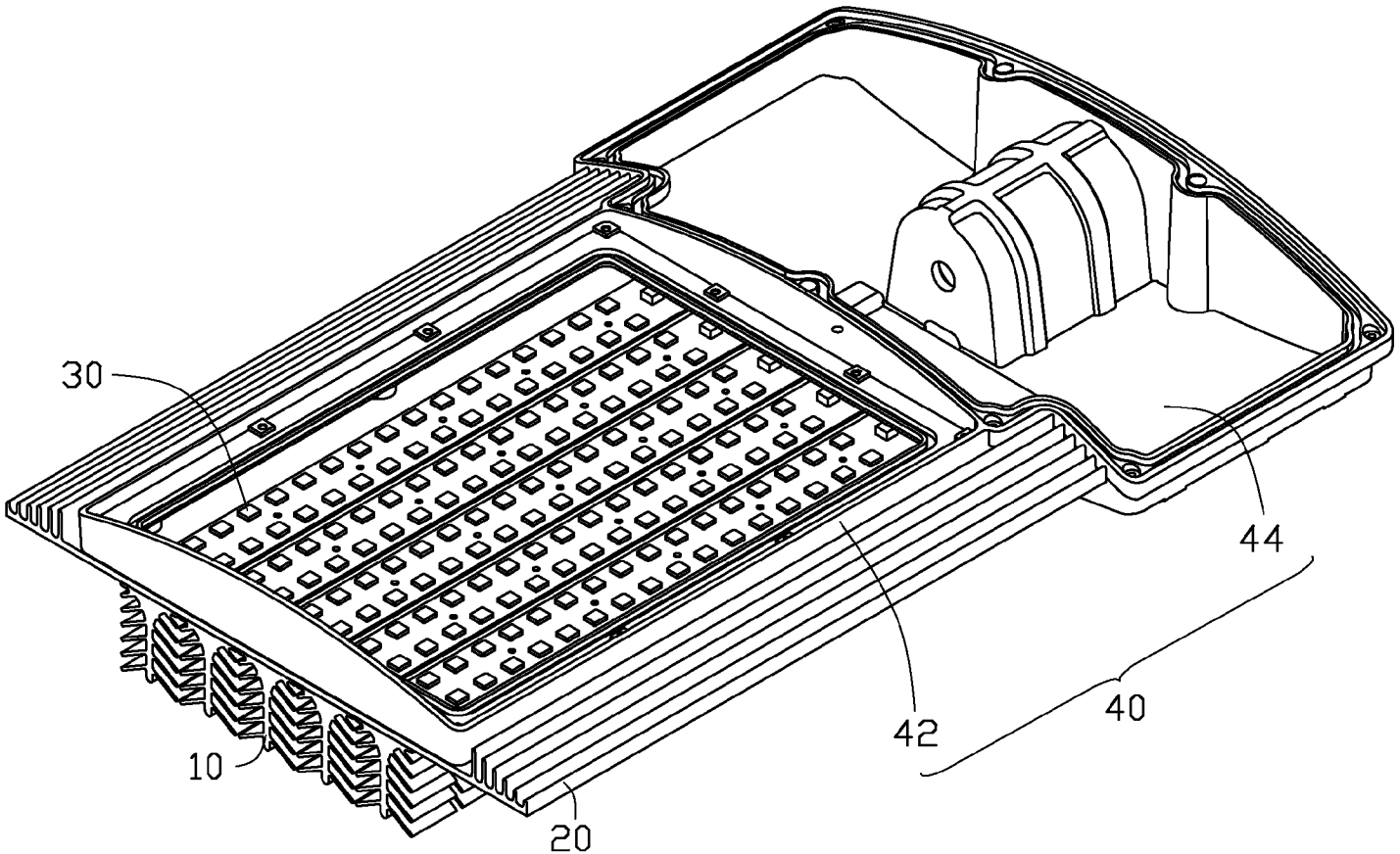
FIG. 1 is an isometric, assembled view of an LED lamp in accordance with a preferred embodiment of the present invention.
Figure 2:
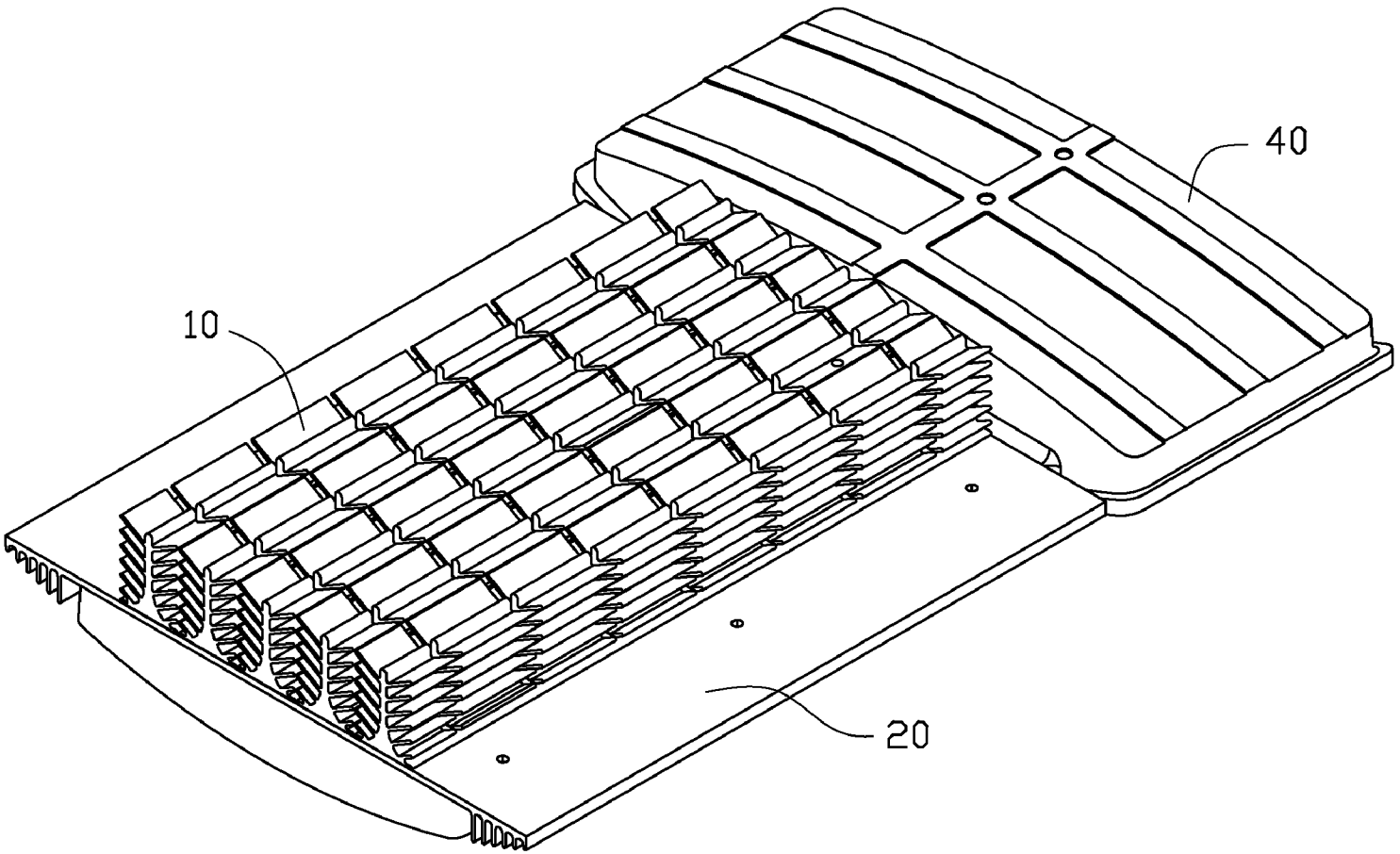
FIG. 2 is an inverted view of FIG. 1.
Figure 3:
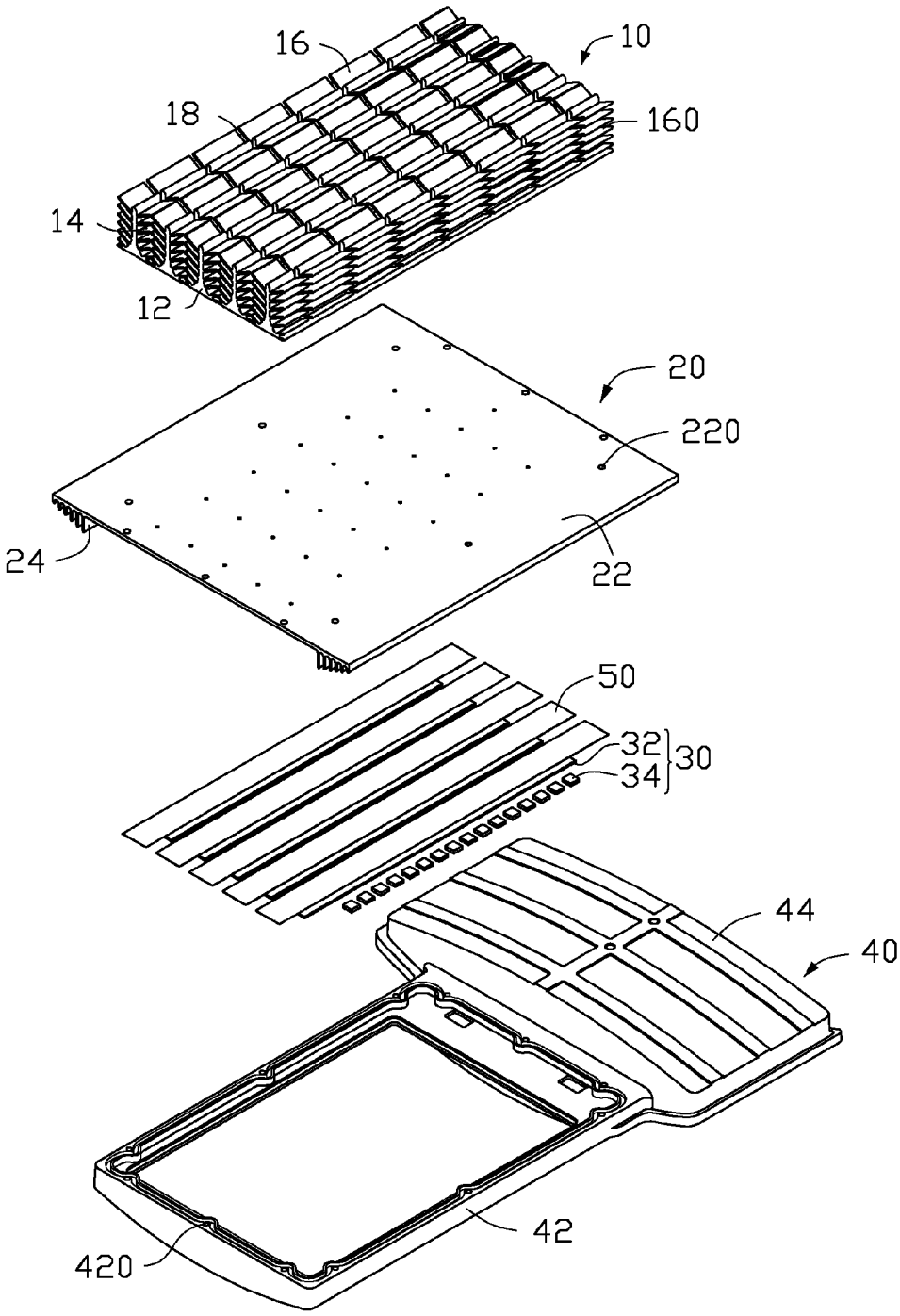
FIG. 3 is an exploded view of the LED lamp of FIG. 2.
Figure 4:
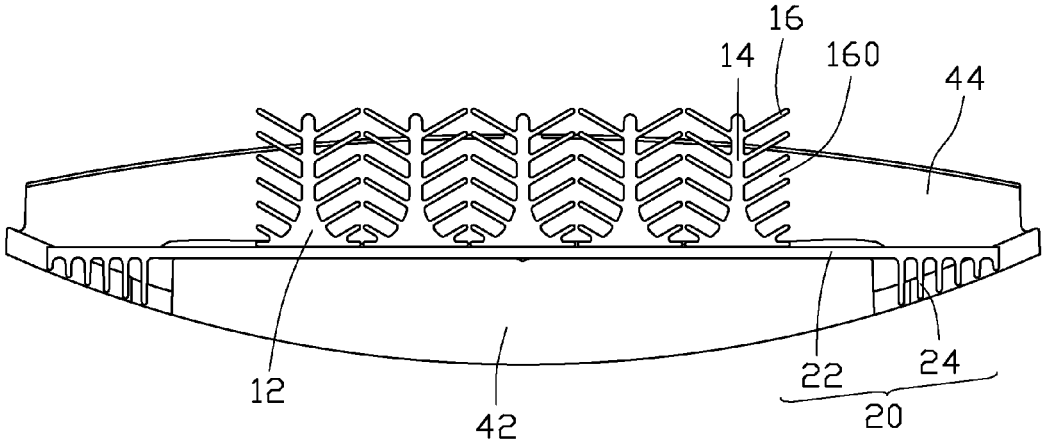
FIG. 4 is a front view of FIG. 2.
Figure 5:
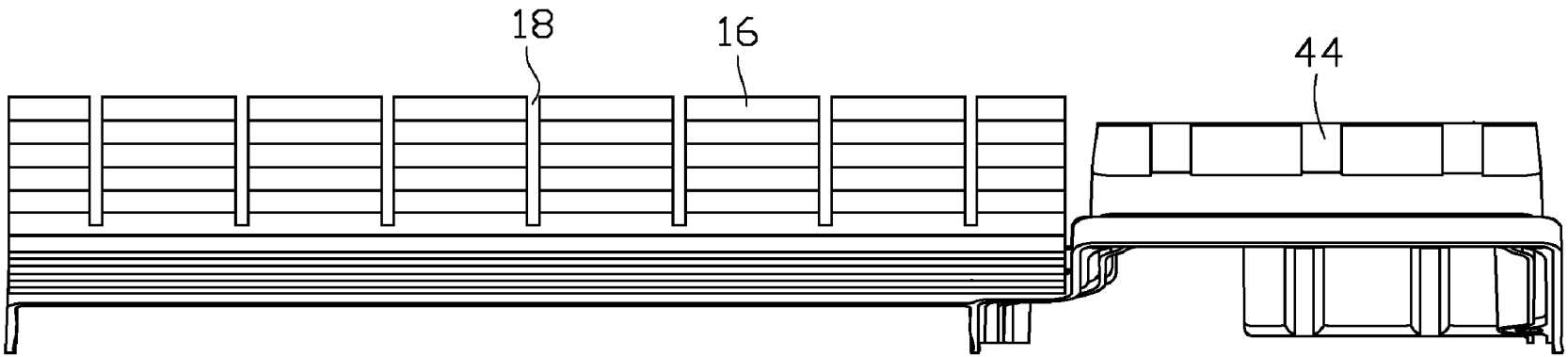
FIG. 5 is a side view of FIG. 2.

Referring to FIGS. 1-5, an LED lamp in accordance with a preferred embodiment is illustrated. The LED lamp comprises a first heat sink 10, a second heat sink 20 attached to the first heat sink 10 and an LED module 30 attached on the second heat sink 20. The first and second heat sinks 10, 20 are used to cool down the LED module 30 to keep the LED module 30 working within an acceptable temperature range. A lamp frame 40 is used to be secured to the second heat sink 20 and cover the LED module 30 therein.

The first heat sink 10 comprises a flat substrate 12 and a plurality of wings 14 vertically and upwardly extending from a first face of the substrate 12. Thickness of each wing 14 is gradually decreased along a direction away from substrate 12 and each wing 14 has the largest thickness at a portion adjacent to the first face of the substrate 12. A plurality of first fins 16 are slantwise extended from two opposite sides of each wing 14 and parallel to each other. A plurality of longitudinal channels 160 are defined between every two adjacent first fins 16 along a lengthwise direction of the substrate 12 of the first heat sink 10. The channels 160 are parallel to two opposite long sides of the substrate 12 of the first heat sink 10. A plurality of transverse grooves 18 are defined through all of the first fins 16 and the wings 14 along a direction parallel to two opposite short sides of the substrate 12 and perpendicular to the channels 160. The grooves 18 interrupt a continuity of the channels 160 and cross with the channels 160. The grooves 18 are arranged at intervals and extend along a direction parallel to the short sides of the substrate 12 of the first heat sink 10 (i.e., the traverse direction of the first heat sink 10). The grooves 18 are extended along a top-bottom direction of the first heat sink 10 and the first fins 16 and all of the channels 160 are divided into a plurality of pairs each of which is transversely aligned. The first fins 16 and the wings 14 are divided into a plurality of small parts separated from each other by the grooves 18.

The second heat sink 20 comprises a substantially rectangular-shaped base 22 and a plurality of second fins 24 extending from a first surface of the base 22. A plurality of through holes 220 corresponding to side edges of the lamp frame 40 are defined in the base 22 of the second heat sink 20 for fixtures (not shown) to extend therethrough to secure the second heat sink 20 to the lamp frame 40. The second fins 24 extend downwardly from two opposite lateral sides of the first surface of the base 22 and perpendicular to the base 22 of the second heat sink 20. The second fins 24 extend along a longitudinal direction of the base 22 and parallel to each other. Heights of the second fins 24 are gradually decreased along a direction away from a middle portion of the base 22 in such a manner that distal ends of the second fins 24 form two side portions of an arc (clearly seen from FIG. 4).

The LED module 30 comprises a plurality of printed circuit boards 32 and a plurality of LEDs 34 arrayed on the printed circuit boards 32. The printed circuit boards 32 each are an elongated bar-shaped plate and mounted side by side on the bare portion of the first surface of the base 22 of the second heat sink 20. Understandably, the printed circuit boards 32 can be replaced by a larger single printed circuit board, whereby the LEDs 34 can be bonded thereon in matrix. A plurality of heat-absorbing plates 50 are used to be thermally attached to the base 22 of the second heat sink 20 and the LED module 30. In this embodiment, the heat-absorbing plates 50 are substantially rectangular metal plates having good heat conductivity, and each have a first face (not labeled) for contacting the printed circuit boards 32 of the LED module 30 and a second face (not labeled) opposite to the first face for contacting the first surface of the base 22 of the second heat sink 20.

The lamp frame 40 comprises a frame body 42 and a cavity body 44 extending from an end of the frame body 42. The frame body 42 defines a plurality of mounting holes 420 along a circumferential direction thereof and corresponding to the through holes 220 of the base 22 of the second heat sink 20, for the fixtures to extend therein to secure the base 22 of the second heat sink 20 to the frame body 42 of the lamp frame 40.

In assembly, the first heat sink 10 is mounted on a second surface opposite to the first surface of the base 22 of the second heat sink 20. The heat-absorbing plates 50 are thermally attached to the bare portion of the first surface of the base 22 of the second heat sink 20 and the LED module 30 are attached to the heat-absorbing plates 50. The second heat sink 20 with the first heat sink 10 and the LED module 30 is then mounted on the frame body 42 of the lamp frame 40 via the fixtures such as screws (not shown), which extend through the through holes 220 of the base 22 of the second heat sink 20 and screw into the mounting holes 420 of the frame body 42 of the lamp frame 40, thereby to secure the second heat sink 20 with the first heat sink 10 and the LED module 30 to the lamp frame 40.

In operation, when the LED module 30 is activated to generate light, heat is generated by the LEDs 34. The heat-absorbing plates 50 thermally contacting the printed circuit boards 32 of the LED module 30 absorb the heat from the LEDs 34 of the LED module 30. The base 22 of the second heat sink 20 absorbs the heat and most of the heat is transferred to the first fins 16 of the first heat sink 10 via the base 22, whereby the first heat sink 10 has a higher temperature than the surrounding air. Due to the higher temperature of the first heat sink 10, a natural air convection is occurred to the first heat sink 10 wherein air surrounding the first fins 16 is heated thereby and leaves the first heat sink 10. Cool air flows to replace the leaved heated air, whereby the heat in the first heat sink 10 is taken away and the second heat sink 20 and the LED module 30 accordingly are cooled.

By the provision of the transverse grooves 18 being defined in the first heat sink 10 and perpendicular to the channels 160 to interrupt continuity of the channels 160, the heated air can leave the first heat sink 10 along the traverse and lengthwise directions. Moreover, the provision of the channels 160 and grooves 18 increases the contact area between the first fins 16 of the first heat sink 10 and the surrounding air. Accordingly, the amount of the air heated by the first fins 16 can be increased and the air heated by the first fins 16 can quickly leave the first fins 16 to be replaced by cool air to obtain a good natural air convection for the first heat sink 10.

In use, the base 22 of the second heat sink 20 thermally contacts the heat-absorbing plates 50 which are attached to the printed circuit boards 32 of the LED module 30 and absorb the heat from the LEDs 34 of the LED module 30. The base 22 of the second heat sink 20 then directly transfers the heat to the first and second fins 16, 24 to be dissipated to ambient air. The heat generated by the LEDs 34 of the LED module 30 can be very quickly dissipated to the surrounding air via the first and second fins 16, 24, to thereby enable the LEDs 34 to work within the predetermined temperature range.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A light emitting diode (LED) lamp, comprising:

a first heat sink comprising a substrate and a plurality of first fins arranged on the substrate;

a second heat sink comprising a base having opposite first and second faces, a plurality of second fins extending from lateral sides of the first face thereof, the second face of the base of the second heat sink being attached on the substrate of the first heat sink;

an LED module mounted to the first face of the base of the second heat sink and located between the second fins extending from the lateral sides of the first face of the base of the second heat sink;

wherein a plurality of channels each are defined between two neighboring first fins of the first heat sink along a first direction, a plurality of grooves extending through the first fins of the first heat sink and crossing with corresponding channels, the channels being divided into a plurality of parts separated from each other by the grooves.

2. The LED lamp as claimed in claim 1, wherein the grooves are transversely defined in the first fins of the first heat sink along a second direction perpendicular to the first direction.

3. The LED lamp as claimed in claim 2, wherein the grooves are arranged at intervals and extend along a direction parallel to lateral sides of the first heat sink.

4. The LED lamp as claimed in claim 3, wherein the first heat sink comprises a plurality of wings extending from the substrate thereof and the first fins are extended from two opposite lateral sides of the wings, the grooves being extended through the first fins and the wings of the first heat sink along a top-bottom direction of the first heat sink.

5. The LED lamp as claimed in claim 4, wherein the wings are perpendicular to the substrate of the first heat sink and each have a largest thickness adjacent to the substrate of the first heat sink.

6. The LED lamp as claimed in claim 4, wherein the first fins of the first heat sink are slantwise extended from the wings and parallel to each other.

7. The LED lamp as claimed in claim 4, wherein heights of the second fins of the second heat sink are gradually decreased along a direction away from a middle portion of the base of the second heat sink.

8. The LED lamp as claimed in claim 7, wherein a plurality of through holes are defined through the base of the second heat sink, adapted for extension of fixtures therethrough to mount the second heat sink to a supporting structure.

9. The LED lamp as claimed in claim 7, wherein the second fins of the second heat sink are perpendicular to the base and parallel to the lateral sides of the base of the second heat sink.

10. The LED lamp as claimed in claim 1, further comprising a lamp frame mounted on the base of the second heat sink and covering the LED module therein.

11. The LED lamp as claimed in claim 10, wherein the lamp frame comprises a frame body and a cavity body extending from the frame body, the base of the second heat sink being secured to the frame body of the lamp frame and the LED module mounted on the first face of the base of the second heat sink being received in the frame body.

* * * * *